US005082761A

United States Patent [19]

Tasaka et al.

[11] Patent Number: 5,082,761

[45] Date of Patent: Jan. 21, 1992

[54] SET OF ELECTROPHOTOGRAPHIC TONERS

[75] Inventors: Shigeaki Tasaka; Nobuhiko Nakano, both of Yamatokoriyama; Kazuya Maeda, Yao; Toshihisa Ishida, Nara; Yoshiaki Takahashi, Ikoma; Tadashi Nakamura; Satoshi Yamaue, both of Nara; Kumiko Nakamura, Sakurai, all of Japan

[73] Assignee: Sharp Kabushiki Kaisha, Osaka, Japan

[21] Appl. No.: 617,934

[22] Filed: Nov. 26, 1990

Related U.S. Application Data

[63] Continuation of Ser. No. 308,789, Feb. 10, 1989, abandoned.

[30] Foreign Application Priority Data

| | | | |
|---|---|---|---|
| Feb. 12, 1988 | [JP] | Japan | 63-31655 |
| Dec. 29, 1988 | [JP] | Japan | 63-331008 |
| Dec. 29, 1988 | [JP] | Japan | 63-331009 |

[51] Int. Cl.[5] ..... G03G 9/08

[52] U.S. Cl. ..... 430/137; 430/110; 430/111; 430/120

[58] Field of Search ..... 430/110, 111, 137, 105, 430/120

[56] References Cited

U.S. PATENT DOCUMENTS

| | | | |
|---|---|---|---|
| 4,187,329 | 2/1980 | Crooks | 430/110 |
| 4,741,984 | 5/1988 | Imai et al. | 430/110 |
| 4,824,754 | 4/1989 | Mikami | 430/110 |

FOREIGN PATENT DOCUMENTS

| | | | |
|---|---|---|---|
| 53-81127 | 7/1978 | Japan | 430/110 |
| 53-147541 | 12/1978 | Japan | 430/110 |
| 54-43736 | 4/1979 | Japan | 430/110 |
| 157755 | 12/1980 | Japan | 430/120 |
| 83864 | 5/1983 | Japan | 430/120 |
| 60-186857 | 9/1985 | Japan | 430/111 |
| 914703 | 1/1963 | United Kingdom | 430/110 |
| 2107892 | 5/1983 | United Kingdom | 430/111 |

*Primary Examiner*—Roland Martin

[57] ABSTRACT

A set of electrophotographic toners used for electrophotographic machines are disclosed which comprise an initial supply toner and a supplementary toner, both of which are composed of toner powder and additives adhering to the surface of the toner powder, wherein the weight ratio x of additives to toner powder in the initial supply toner is set to be greater than the weight ratio y of additives to toner powder in the supplementary toner.

9 Claims, 1 Drawing Sheet

SET OF ELECTROPHOTOGRAPHIC TONERS

This application is a continuation of application Ser. No. 07/308,789 filed on Feb. 10, 1989 which is now abandoned.

BACKGROUND OF THE INVENTION

1. Field of the Invention

This invention relates to a set of electrophotographic toners which are used for electrophotographic machines such as electrostatic copying machines and laser printers.

2. Description of the Prior Art

In electrostatic copying machines (hereinafter referred to as copying machines) which utilize a binary developer comprising an electrophotographic toner (hereinafter referred to as a toner) and a carrier, an initial supply toner is contained together with a carrier in a developing apparatus from the beginning of the copying process, while a supplementary toner is contained in a toner hopper. The toner contained in the developing apparatus is mixed with the carrier in this apparatus, resulting in a developer. The developer formed in this way is supplied to a photosensitive drum by magnetic rollers. The toner contained in the toner hopper is supplied to the developing apparatus when a decrease in toner concentration in the developer contained in the developing apparatus is observed by a sensor for detecting toner concentration. Thereafter, the toner supplied to the developing apparatus is mixed with a carrier to form a developer which is then supplied to the photosensitive drum in the same way as mentioned above. The toner contained in the developer is adsorbed by an electrostatic latent image which has been formed on the photosensitive drum, and then transferred to paper, resulting in a desired toner image thereon.

The toner remaining on the surface of the photosensitive drum after the transfer to paper is scraped off the surface of the photosensitive drum by a cleaning blade in a cleaning apparatus.

In conventional copying machines, the supplementary toner contained in the toner hopper is the same as that contained in the developing apparatus from the beginning of the copying process. Usually, the toner mentioned above is composed of toner powder and additives adhering to the surface of the toner powder. This toner powder is obtained by mixing the material used, kneading the mixture, grinding the mixture into powder, and sizing the resulting powder to have a desired mean particle size. As the additives to be used for the toner, there can be mentioned, for example, charge-controlling agents and cleaning agents.

When a toner is used which has a cleaning agent adhering to the surface thereof, it is possible to prevent the toner from making a film on the surface of the photosensitive drum or on the surface of the carrier. Moreover, in the cleaning step, the toner can be readily removed from the surface of the photosensitive drum, and it is also possible to prevent the inversion of the cleaning blade by which the toner is scraped off the surface of the photosensitive drum, so that the cleaning of the surface of the photosensitive drum can be achieved satisfactorily.

However, in the initial stage of the copying process, the amount of cleaning agent in the toner is decreased, so that the cleaning blade tends to be inverted in the cleaning step, thereby making it impossible to remove the toner remaining on the surface of the photosensitive drum. To eliminate such disadvantages, it may be preferred to use a toner with an increased weight ratio of cleaning agent to toner powder. If such toner is used, it will be possible to prevent the inversion of the cleaning blade throughout the copying process. However, a great amount of cleaning agent is required in preparing the toner, which makes production cost significantly high.

In general, when the developer is subjected to a process for making a large number of copies by use of, for example, electrostatic copying machines, deterioration of the carrier in the developer tends to decrease the fluidity of the developer with repetition of the copying operation, so that the bulk density of the developer is increased gradually. This condition is observed as a deficiency of the toner by the sensor for detecting the toner concentration, and the toner is supplied from the toner hopper to the developing apparatus. Therefore, when increasing the number of copies, the amount of toner to be supplied to the developing apparatus is increased, so that the toner concentration in the developer becomes higher than that set in the initial stage of the copying process. Accordingly, conventional types of toner have the disadvantages of requiring increased consumption and of increasing the fog of toner images.

Recently, Japanese Laid-Open Patent Publication No. 55-157755 describes an improved type of electrophotographic toner in which silica adheres as an external additive to the surface of toner powder wherein the ratio of silica to toner powder in the initial supply toner is set to be smaller than that of silica to toner powder in the supplementary toner. However, similarly to the case when the conventional types of electrophotographic toner mentioned above are used, such an improved type of electrophotographic toner would not be able to prevent sufficiently the inversion of the cleaning blade in the initial stage of the copying process. Moreover, when increasing the number of copies, the bulk density of the developer contained in the developing apparatus is increased gradually, so that the toner concentration in the developer becomes high, which gives rise to many disadvantages as mentioned above.

SUMMARY OF THE INVENTION

The set of electrophotographic toners of this invention, which overcome the above-discussed and numerous other disadvantages and deficiencies of the prior art, comprise an initial supply toner and a supplementary toner, both of which are composed of toner powder and additives adhering to the surface of the toner powder, wherein the weight ratio x of additives to toner powder in the initial supply toner is set to be greater than the weight ratio y of additives to toner powder in the supplementary toner.

In a preferred embodiment, the above-mentioned weight ratios x and y meet the relationship, $1.1y \leqq x \leqq 4.0y$.

In a preferred embodiment, the above-mentioned additive is a charge-controlling agent.

In a more preferred embodiment, the charge-controlling agent is fine powder made of at least one material selected from the group consisting of hydrophobic silica, aluminum oxide, zinc oxide, magnesium oxide, calcium carbonate, magnesium carbonate, magnesium hydroxide, barium sulfate, calcium sulfate, magnesium sulfate, and metal salts of fatty acids.

In a more preferred embodiment, the fine powder has a mean particle size of 2 μm or less.

In a preferred embodiment, the above-mentioned additive is a cleaning agent.

In a more preferred embodiment, the cleaning agent is fine beads made of polystyrene or fine powder made of at least one material selected from the group consisting of polyfluoroethylene, zinc stearate, aluminum stearate, calcium stearate, and zinc laurate.

In a more preferred embodiment, the fine powder or fine bead has a mean particle size of 2 μm or less.

Thus, the invention described herein makes possible the objectives of (1) providing a set of electrophotographic toners which can prevent an excessive increase in the toner concentration in the developer, so that increased toner consumption can be avoided and the fog of toner images can be reduced, resulting in a uniform toner image with high quality; (2) providing a set of electrophotographic toners which can prevent the inversion of a cleaning blade due to deficiency of cleaning agents in the initial stage of the copying process, so that a decrease in quality of toner images due to insufficient cleaning of a photosensitive drum can be avoided, resulting in a toner image with high quality; and (3) providing a set of electrophotographic toners which do not require any excess amount of cleaning agent througout the copying process, thereby making it possible to avoid high production cost.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

Figure 1:
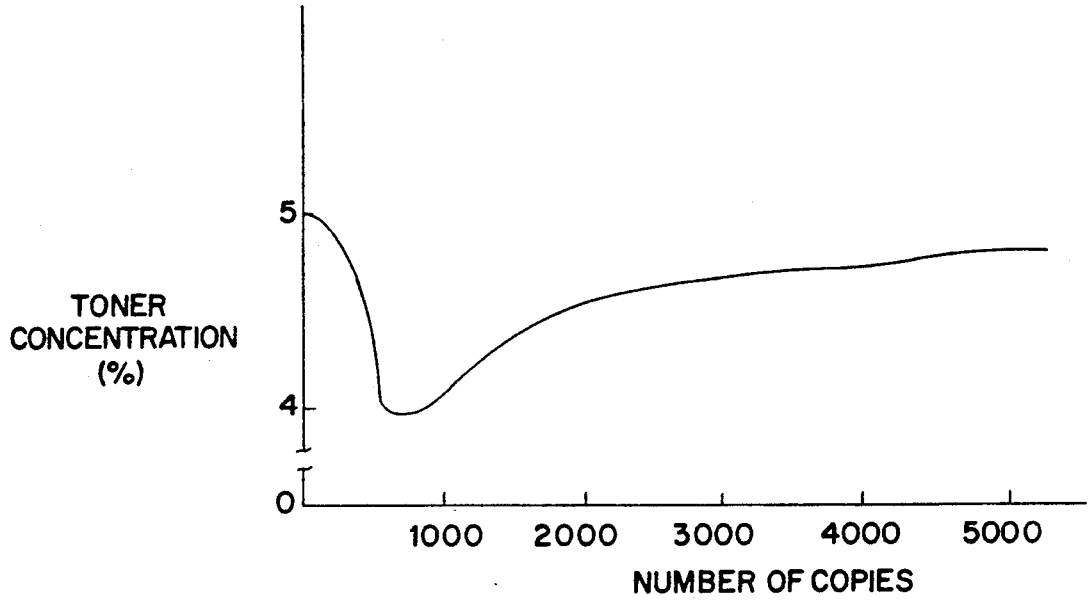
FIG. 1 is a graph showing the relationship between the toner concentration and the number of copies when various sets of electrophotographic toners of this invention are used.

As mentioned above, the set of electrophotographic toners of this invention comprise an initial supply toner and a supplementary toner, both of which are composed of toner powder and additives adhering to the surface of the toner powder. The weight ratio x of additives to toner powder in the initial supply toner is set to be greater than the weight ratio y of additives to toner powder in the supplementary toner. Preferably, the weight ratios x and y meet the relationship, $1.1y \leqq x \leqq 4.0y$, and more preferably, $1.5y \leqq x \leqq 3.0y$.

Examples of additives which can be used are charge-controlling agents, cleaning agents, and the like. As a charge-controlling agent, fine powder can be used which is made of at least one material selected from the group consisting of hydrohobic silica, aluminum oxide, zinc oxide, magnesium oxide, calcium carbonate, magnesium carbonate, magnesium hydroxide, barium sulphate, calcium sulphate, magnesium sulphate, and metal salts of fatty acids. As a cleaning agent, there can be used fine beads made of polystyrene or fine powder made of at least one material selected from the group consisting of polyfluoroethylene, zinc stearate, aluminum stearate, calcium stearate, and zinc laurate. Preferably, the fine bead or fine powder which is used for an additive such as a charge-controlling agent or a cleaning agent has a mean particle size of 2 μm or less. When a charge-controlling agent is used as an additive, it is preferred that the degree of electrification of a developer containing an initial supply toner is set to be 0.4 to 0.8 times that of a developer containing a supplementary toner.

The toner powder mentioned above can be prepared, for example, from the components: a colorant by which the resulting toner is colored; a resinous binder by which the colorant is fixed on paper; a charge-controlling agent which gives a desired degree of electrification to the resulting toner; and an anti-tack agent which prevents the resulting toner from adhering to fixing rollers.

Examples of resinous binders which can be used are polystyrene, styrene copolymers such as styrene-butadiene copolymers and styrene-acrylate copolymers, polyethylene, ethylene copolymers such as ethylene-vinyl acetate copolymers and ethylene-vinyl alcohol copolymers, phenol resins, epoxy resins, diallyl phthalate resins, polyamide resins, polyester resins, and maleic resins.

Examples of colorants which can be used are carbon black, nigrosines, aniline black, chalco oil blue, chrome yellow, ultramarine yellow, methylene blue, du Pont oil red, quinoline yellow, methylene blue chloride, phthalocyanine blue, malachite green, oxalate, lampblack, rose bengal, and mixtures thereof. The toner powder should contain a sufficient amount of colorant to form a distinct toner image.

Examples of charge-controlling agents which can be used are amino compounds, quaternary ammonium salts such as N-benzy-N,N-dimethyl-N-hexadecylammonium chloride and N-decyl-N,N,N-trimethylammonium chloride, and organic dyes, particularly basic dyes and salts thereof such as nigrosine, nigrosine hydrochloride, safranine, and crystal violet. Among these, nigrosine and nigrosine hydrochloride are sometimes used as a positive-charge controlling agent.

Examples of anti-tack agents which can be used are polypropylene, polyethylene, and paraffin wax. When used individually to prepare the toner, these anti-tack agents are quite useful in providing the improved release of the toner from the fixing rollers.

When a charge-controlling agent is used as an additive to be attached to the surface of the toner powder, if the weight ratio of charge-controlling agent to toner powder in the initial supply toner is set to be greater than that of charge-controlling agent to toner powder in the supplementary toner, the degree of electrification of the developer will be small in the initial stage of the copying process. When increasing the number of copies, the developer is well mixed to increase the degree of electrification thereof, so that the bulk density of the developer is decreased, thereby making it difficult to supply toner to the developing apparatus.

Thus, the toner concentration in the developer is decreased, for example, by 10 to 20% of the initial toner concentration when 500 copies or less are taken. Thereafter, the bulk density of the developer is increased by the deterioration of carriers, so that the amount of toner supplied to the developing apparatus is increased gradually. However, because the toner concentration has already been decreased to a certain level, it is possible to prevent the toner concentration in the developer contained in the developing apparatus from being increased significantly.

The set of electrophotographic toners of this invention will be further illustrated by reference to the following examples wherein, as an additive to be attached to the surface of toner powder, charge-controlling agents are used in Examples 1–3 and Comparative Examples 1 and 2, and cleaning agents are used in Examples 4–6 and Comparative Example 3.

EXAMPLE 1

First, toner powder was prepared from the following mixture of components:

| Component | Parts by Weight |
|---|---|
| Polystyrene | 85 |
| Carbon black | 5 |
| Nigrosine | 5 |
| Polyethylene | 5 |

The components were mixed together in the proportion indicated above. After melted and kneaded, the mixture was ground into powder and sized to have a given mean particle size, resulting in toner powder.

Thereafter, 0.5 parts by weight of powdered hydrophobic silica (the mean particle size thereof being 1 μm or less; available from Nippon Aerosil Co., as R-972) was added to the toner powder and mixed, so that the hydrophobic silica adhered to the surface of the toner powder, resulting in an initial supply toner.

Then, 50 g of the initial supply toner and 950 g of iron powder used as a carrier were mixed together by use of a mixer to yield a developer with the toner concentration of 5%. The degree of electrification of the developer obtained was 10 μc/g at the time when preparation was completed.

On the other hand, 0.3 parts by weight of the same powdered hydrophobic silica as above was added to the above-mentioned toner and mixed, so that the hydrophobic silica adhered to the surface of the toner powder, resulting in a supplementary toner.

Next, by the use of the developer, which contained the initial supply toner, and the supplementary toner, measurements were made of any change in the degree of electrification of the developer contained in the developing apparatus.

When the developer and the supplementary toner were used for an electrostatic copying machine, the degree of electrification of the developer was increased from 10 μc/g to 18 μc/g by the mixing of the developer in the developing apparatus. Thus, the bulk density of the developer changed therewith, so that the toner concentration in the developer was decreased from 5% to 4%, as shown in FIG. 1, at a time when approximately 500 copies or less were taken. That is, the toner concentration was decreased by 20% of the initial toner concentration. Thereafter, the toner concentration was gradually increased by the decrease in fluidity of the developer. However, the toner concentration approached a constant value less than the initial toner concentration of 5% because the toner concentration had already been decreased to a certain level in the initial stage of the copying process as mentioned above. Thus, the fog of toner images was not increased, so that uniform toner images with high quality were obtained.

EXAMPLE 2

In a manner similar to that of Example 1, a developer containing an initial supply toner, and a supplementary toner were prepared, except that powdered aluminum oxide with a mean particle size of 1 μm or less was used in place of the powdered hydrophobic silica. The degree of electrification of the developer was 14 μc/g at the time when preparation was completed.

When the developer and the supplementary toner were used for an electrostatic copying machine, the degree of electrification of the developer was increased from 14 μc/g to 20 μc/g by the mixing of the developer in the developing apparatus. The change in toner concentration in the developer contained in the developing apparatus were similar to that of Example 1. Thus, the fog of toner images was not increased, so that uniform toner images with high quality were obtained.

EXAMPLE 3

In a manner similar to that of Example 1, a developer containing an initial supply toner, and a supplementary toner were prepared, except that powdered zinc oxide with a mean particle size of 1 μm or less was used in place of the powdered hydrophobic silica. The degree of electrification of the developer was 11 μc/g at the time when preparation was completed.

When the developer and the supplementary toner were used for an electrostatic copying machine, the degree of electrification of the developer was increased from 11 μc/g to 18 μc/g by the mixing of the developer in the developing apparatus. The change in toner concentration in the developer contained in the developing apparatus were similar to that of Example 1. Thus, the fog of toner images was not increased, so that uniform toner images with high quality were obtained.

COMPARATIVE EXAMPLE 1

In a manner similar to that of Example 2, a developer containing an initial supply toner, and a supplementary toner which was the same as the initial supply toner were prepared, except that 0.3 parts by weight of powdered aluminum oxide was used for making the initial supply toner. The degree of electrification of the developer was 20 μc/g at the time when preparation was completed.

Figure 2:
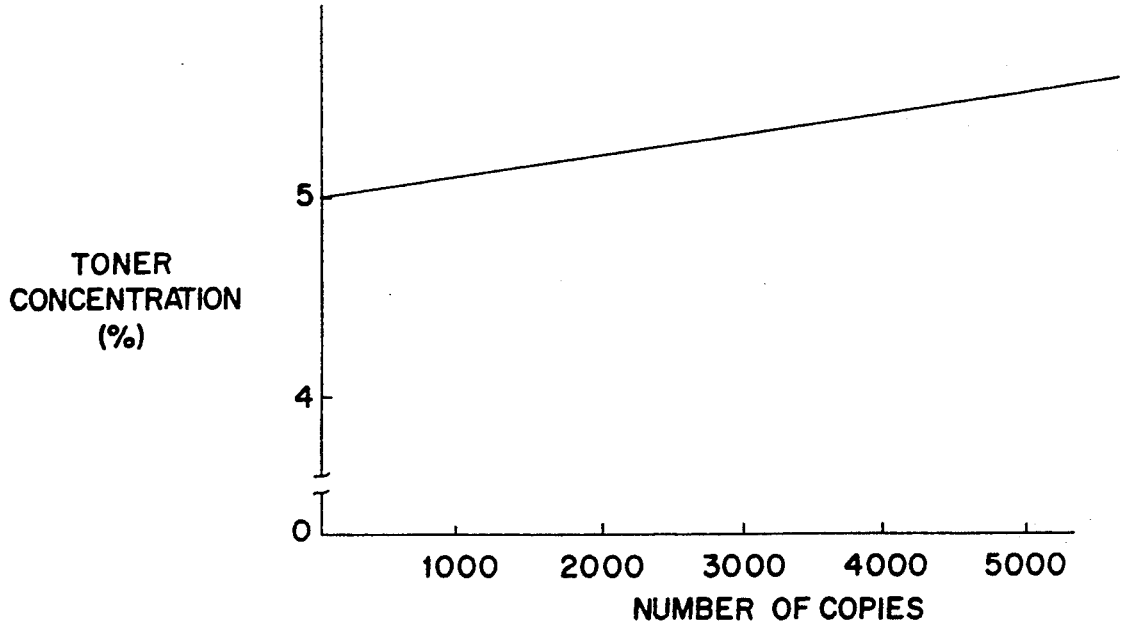
FIG. 2 is a graph showing the relationship between the toner concentration and the number of copies when conventional types of electrophotographic toner are used.

When the developer and the supplementary toner were used for an electrostatic copying machine, the toner concentration was increased as the number of copies increased as shown in FIG. 2. Thus, the fog of toner images was gradually increased, so that the quality of toner images was poor.

COMPARATIVE EXAMPLE 2

In a manner similar to that of Example 3, a developer containing an initial supply toner, and a supplementary toner which was the same as the initial supply toner were prepared, except that 0.3 parts by weight of powdered zinc oxide was used for making the initial supply toner. The degree of electrification of the developer was 20 μc/g at the time when preparation was completed.

When the developer and the supplementary toner were used for an electrostatic copying machine, the toner concentration was increased as the number of copies increased as shown in FIG. 2. Thus, the fog of toner images was gradually increased, so that the quality of toner images was poor.

EXAMPLE 4

First, toner powder was prepared from the following mixture of components:

| Component | Parts by Weight |
|---|---|
| Styrene-acrylate copolymer | 85 |
| Carbon black | 5 |
| Nigrosine | 5 |
| Polypropylene | 5 |

The components were mixed together in the proportion indicated above. After melted and kneaded, the mixture was ground into powder and sized, resulting in toner powder with a mean particle size of 5 to 20 μm.

Thereafter, 0.5 parts by weight of powdered zinc stearate with a mean particle size of 2 μm or less was added to 100 parts by weight of the toner powder and mixed, so that the zinc stearate adhered to the surface of the toner powder, resulting in an initial supply toner.

Then, 50 g of the initial supply toner and 950 g of iron powder (the mean particle size thereof being 300 μm) used as a carrier were mixed together by use of a mixer to yield a developer with the toner concentration of 5%.

On the other hand, 0.2 parts by weight of the same powdered zinc stearate as above was added to 100 parts by weight of the above-mentioned toner and mixed, so that the zinc stearate adhered to the surface of the toner powder, resulting in a supplementary toner.

Next, the developer and the supplementary toner were used for taking copies from an electrostatic copying machine. The developer was charged in the developing apparatus and the supplementary toner was charged in the toner hopper. Then, 40,000 copies were successively taken. It was found that the inversion of the cleaning blade did not occur in the initial stage of copying process, so that there was no problem of insufficient cleaning of the photosensitive drum. This condition was maintained even after the initial stage of the copying process, e.g., at a time when the supplementary toner was supplied to the developing apparatus. Thus, there occurred no decrease in quality of toner images due to the insufficient cleaning of the photosensitive drum or due to the formation of a film of toner on the surface of the photosensitive drum, so that uniform toner images with high quality were obtained throughout the copying process of taking 40,000 copies.

EXAMPLE 5

In a manner similar to that of Example 4, a developer containing an initial supply toner, and a supplementary toner were prepared, except that powdered ethylene copolymer with a mean particle size of 2 μm or less was used in place of the powdered zinc stearate.

The developer and the supplementary toner were used for taking 40,000 copies successively from an electrostatic copying machine. It was found that there occurred no inversion of the cleaning blade and there occurred no formation of a film of toner on the surface of the photosensitive drum, so that uniform toner images with high quality were obtained throughout the copying process of taking 40,000 copies.

EXAMPLE 6

In a manner similar to that of Example 4, a developer containing an initial supply toner, and a supplementary toner were prepared, except that powdered calcium stearate with a mean particle size of 2 μm or less was used in place of the powdered zinc stearate.

The developer and the supplementary toner were used for taking 40,000 copies successively from an electrostatic copying machine. It was found that there occurred no inversion of the cleaning blade and there occurred no formation of a film of toner on the surface of the photosensitive drum, so that uniform toner images with high quality were obtained throughout the copying process of taking 40,000 copies.

COMPARATIVE EXAMPLE 3

In a manner similar to that of Example 4, a developer containing an initial supply toner, and a supplementary toner which was the same as the initial supply toner were prepared, except that 0.2 parts by weight of powdered zinc stearate with a mean particle size of 2 μm or less was used for making the initial supply toner.

The developer and the supplementary toner were used for taking 40,000 copies successively from an electrostatic copying machine. It was found that the inversion of the cleaning blade occurred in the initial stage of the copying process, so that the quality of toner images was poor. After the initial stage of the copying process, e.g., at a time when the supplementary toner was supplied to the developing apparatus, there occurred no further decrease in quality of toner images.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A method of supplying a set of electrophotographic toners used for electrophotographic machines, comprising the steps of supplying an initial supply toner and supplying a supplementary toner, both of which are composed of toner powder and additives adhering to the surface of said toner powder, wherein said additives include a cleaning agent, and the weight ratio x of additives to toner powder in said initial supply toner and the weight ratio y of said additives to said toner powder in said supplementary toner satisfy the relationship, $1.1y \leqq x \leqq 4.0y$, thereby preventing inversion of the cleaning blade in an initial stage of a copying process.

2. The method of claim 1, wherein said cleaning agent is fine beads made of polystyrene or fine powder made of at least one material selected from the group consisting of polyfluoroethylene, zinc stearate, aluminum stearate, calcium stearate, and zinc laurate.

3. The method of claim 2, wherein said fine powder or said fine bead has a mean particle size of 2 μm or less.

4. A method of supplying electrophotographic machines with a set of electrophotographic toners, comprising the steps of:

supplying an initial supply toner; and supplying a supplementary toner, both of said initial supply toner and said supplementary toner being composed of toner powder and additives adhering to the surface of said toner powder, wherein said additives include a cleaning agent, and the weight ratio x of additives to toner powder in said initial supply toner and the weight ratio y of said additives to said toner powder in said supplementary toner satisfy the relationship, $1.1y \leqq x \leqq 4.0y$, thereby preventing inversion of the cleaning blade in an initial stage of a copying process.

5. The method of claim 4, wherein said cleaning agent is fine beads made of polystyrene.

6. The method of claim 4, wherein said cleaning agent is fine powder made of at least one material selected from the group consisting of polyfluroethylene, zinc stearate, aluminum stearate, calcium stearate, and zinc laureate.

7. The method of claim 5, wherein said fine beads have a mean particle size of not more than 2 μm.

8. The method of claim 6, wherein said fine powder has a mean particle size of not more than 2 μm.

9. The method of claim 4, wherein said weight ratios x and y further satisfy the relationship $1.1y \leqq x \leqq 3.0y$.

* * * * *